US009164408B2

(12) United States Patent
Aoki et al.

(10) Patent No.: US 9,164,408 B2
(45) **Date of Patent: *Oct. 20, 2015**

(54) ELECTROPHOTOGRAPHIC TONER

(75) Inventors: Takayasu Aoki, Shizuoka-ken (JP); Koji Imamiya, Kanagawa-ken (JP); Tsuyoshi Itou, Shizuoka-ken (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 194 days.

This patent is subject to a terminal disclaimer.

(21) Appl. No.: 13/093,142

(22) Filed: Apr. 25, 2011

(65) Prior Publication Data

US 2011/0262857 A1 Oct. 27, 2011

Related U.S. Application Data

(60) Provisional application No. 61/327,861, filed on Apr. 26, 2010.

(51) Int. Cl.

| | |
|---|---|
| ***G03G 9/093*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0806* (2013.01); *G03G 9/08755* (2013.01); *G03G 9/08793* (2013.01); *G03G 9/08797* (2013.01); *G03G 9/0926* (2013.01); *G03G 9/0928* (2013.01)

(58) Field of Classification Search

CPC ..... G03G 9/0806; G03G 9/08755; G03G 9/0928; G03G 9/08797; G03G 9/0926; G03G 9/08793

USPC ..... 430/108.1, 109.4

See application file for complete search history.

(56) References Cited

U.S. PATENT DOCUMENTS

| | | | | |
|---|---|---|---|---|
| 5,362,592 | A | 11/1994 | Murofushi et al. | |
| 5,432,534 | A * | 7/1995 | Maruyama et al. | 347/172 |
| 5,449,583 | A | 9/1995 | Murofushi et al. | |
| 5,986,017 | A * | 11/1999 | Katagiri et al. | 525/438 |
| 6,203,603 | B1 * | 3/2001 | Takayama et al. | 106/31.16 |
| 6,329,317 | B1 * | 12/2001 | Takayama et al. | 503/201 |

(Continued)

FOREIGN PATENT DOCUMENTS

| | | |
|---|---|---|
| EP | 2256556 A2 | 12/2010 |
| EP | 2325700 A2 | 5/2011 |

(Continued)

OTHER PUBLICATIONS

European Search Report for Application No. 11163493.7-1217 mailed on Aug. 3, 2011.

(Continued)

*Primary Examiner* — Jonathan Jelsma

(74) *Attorney, Agent, or Firm* — Foley & Lardner LLP

(57) ABSTRACT

An electrophotographic toner contains an electron donating color developable agent, an electron accepting color developing agent, and a polyester resin binder which is a polyester resin obtained by polycondensation of a carboxylic acid component and an alcohol component and has a crosslinked structure formed of a crosslinking component including at least either one of a trivalent or higher valent carboxylic acid and a trihydric or higher hydric alcohol, and is decolorized by heating.

3 Claims, 2 Drawing Sheets

(56) References Cited

U.S. PATENT DOCUMENTS

| | | | | |
|---|---|---|---|---|
| 8,557,495 | B2 | 10/2013 | Kabai et al. | |
| 2003/0091790 | A1* | 5/2003 | Fujisawa | 428/141 |
| 2005/0191082 | A1 | 9/2005 | Takayama et al. | |
| 2007/0207402 | A1* | 9/2007 | Takagi et al. | 430/110.2 |
| 2009/0011347 | A1* | 1/2009 | Daimon et al. | 430/48 |
| 2010/0209839 | A1 | 8/2010 | Kabai et al. | |
| 2010/0304286 | A1 | 12/2010 | Aoki et al. | |
| 2010/0316947 | A1* | 12/2010 | Mizuhata et al. | 430/109.4 |
| 2011/0123921 | A1 | 5/2011 | Aoki et al. | |
| 2012/0282544 | A1 | 11/2012 | Kabai et al. | |
| 2012/0282545 | A1 | 11/2012 | Kabai et al. | |

FOREIGN PATENT DOCUMENTS

| | | | |
|---|---|---|---|
| EP | 2341394 | A1 | 7/2011 |
| JP | 05-241369 | | 9/1993 |
| JP | 2000-330321 | | 11/2000 |
| JP | 2010-191430 | | 9/2010 |
| JP | 2010-277084 | | 12/2010 |

OTHER PUBLICATIONS

Office Action of Notification of Reasons for Refusal for Japanese Patent Application No. 2011-098641 dated Dec. 10, 2013, 3 pgs.

* cited by examiner

FIG.2

| | Example 1 | Example 2 | Example 3 | Comparative Example 1 | Comparative Example 2 |
|---|---|---|---|---|---|
| Weight average molecular weight | 8200 | 7500 | 8500 | 7500 | 5800 |
| Content of trimellitic acid (wt%) | 12 | 15 | 5 | 0 | 0 |
| Toluene insoluble content (%) | 35 | 28 | 20 | 15 | 12 |
| Fixing temperature (C) | 90 | 88 | 85 | 85 | 80 |
| Decolorization temperature (C) | 120 | 120 | 120 | 120 | 120 |
| Glossiness in decolorized region | 5 | 6 | 9 | 12 | 35 |

ELECTROPHOTOGRAPHIC TONER

CROSS-REFERENCE TO RELATED APPLICATIONS

This application is based upon and claims the benefit of priority from: U.S. provisional application 61/327,861, filed on Apr. 26, 2010; the entire contents of which are incorporated herein by reference.

FIELD

Embodiments described herein relate to a technique for a decolorizable toner which is decolorized by heating.

BACKGROUND

Conventionally, in order to enable the reuse of paper used for printing or note-taking for the purpose of temporal transfer, display, or the like of information, a heat-sensitive recording medium (heat-sensitive paper) capable of erasing printing by heating, or a pigment or the like, which is decolorized by heating, is used.

Further, as a toner for an image forming apparatus such as a multifunction peripheral (MFP), a so-called decolorizable toner, which is decolorized by heating, is also used. A sheet having an image formed thereon using the decolorizable toner can be recycled after the image is decolorized because the toner is decolorized by heating.

However, the conventional decolorizable toner has problems that the decolorization performance is not sufficient, and for example, a gloss in a region where an image formed on a sheet was decolorized is noticeable, and so on.

DESCRIPTION OF THE DRAWINGS

FIG. 2 is a table showing evaluation of toners of Examples and Comparative Examples according to a first embodiment.

DETAILED DESCRIPTION

Figure 1:
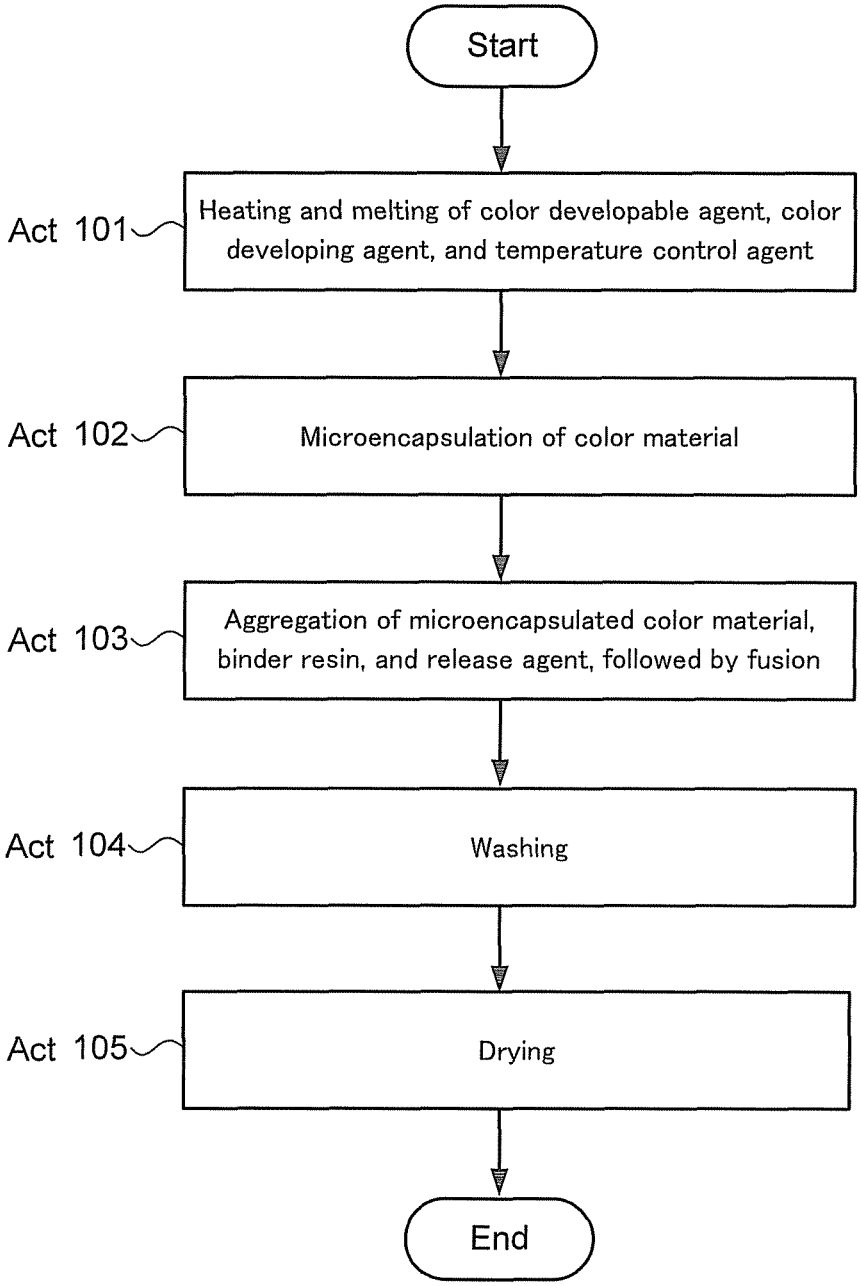
FIG. 1 is a flow chart showing a flow of a process for producing a toner.

In general, according to an embodiment, an electrophotographic toner contains a color developable agent, a color developing agent, and a binder resin. The color developable agent is an electron donating compound. The color developing agent is an electron accepting compound. The binder resin is a polyester resin which is obtained by polycondensation of a carboxylic acid component and an alcohol component and has a crosslinked structure formed of a crosslinking component including at least either one of a trivalent or higher valent carboxylic acid and a trihydric or higher hydric alcohol.

Hereinafter, embodiments will be described with reference to the drawings.

First Embodiment

An electrophotographic toner according to this embodiment is a so-called decolorizable toner which is decolorized by heating.

The toner according to this embodiment contains at least an electron donating color developable agent, an electron accepting color developing agent, and a binder resin.

The electron donating color developable agent is a dye precursor compound to be used for displaying characters, figures, etc. As the electron donating color developable agent, a leuco dye can be mainly used. The leuco dye is an electron donating compound capable of developing a color by the action of a color developing agent, and examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-1-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The electron accepting color developing agent is an electron accepting compound which causes the color developable agent to develop a color by interacting with the color developable agent. Also the electron accepting color developing agent is an electron accepting compound which donates a proton to the electron donating color developable agent such as a leuco dye.

Examples of the electron accepting color developing agent include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof.

The binder resin is melted by a fixing treatment and fixes a coloring material on a sheet.

As the binder resin, a polyester resin obtained by subjecting a dicarboxylic acid component and a diol component to an esterification reaction, followed by polycondensation is preferably used. For example, when a styrene resin is used as the binder resin, a styrene resin generally has a higher glass transition point than a polyester resin and therefore is disadvantageous from the viewpoint of low-temperature fixing.

Examples of the dicarboxylic acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component (diol component) include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; and alicyclic diols such as 1,4-cyclohexanediol and 1,4-cyclohexanedimethanol. Additional examples thereof include ethylene oxide adducts or propylene oxide adducts of bisphenol A (such as bisphenol A alkylene oxide adducts).

Further, the binder resin according to this embodiment is a polyester resin having a crosslinked structure formed of a crosslinking component including at least either one of a trivalent or higher valent carboxylic acid and a trihydric or higher hydric alcohol.

The crosslinking component is not limited as long as the component is a trivalent or higher valent carboxylic acid or a trihydric or higher hydric alcohol, however, for example, as the trivalent or higher valent carboxylic acid, 1,2,4-benzenetricarboxylic acid (trimellitic acid) can be used. Further, as the trihydric or higher hydric alcohol, glycerin can be used.

By adding such a crosslinking component, a crosslinking reaction is carried out, and therefore, a polyester resin having a large molecular weight is formed. In such a case, a polymer which is hardly melted exists even if a heating is performed for decolorization. Therefore, as compared with a polymer having a low molecular weight, a smooth surface is unlikely to be obtained, and as a result, a gloss after decolorization is considered to be suppressed.

From the viewpoint of suppressing a gloss, as the crosslinking component, 1,2,4-benzenetricarboxylic acid is most preferred.

The crosslinking component is preferably contained in an amount of 3 wt % or more and 15 wt % or less of the total amount of the binder resin. If the amount thereof is 3 wt % or more, an effect of suppressing a gloss can be more reliably obtained. Further, if the amount thereof is 15 wt % or less, the fixing temperature is not too high, and therefore, the amount of 15 wt % or less is preferred from the viewpoint of low-temperature fixability.

Incidentally, as the binder resin, two or more types of polyester resins having different compositions may be mixed and used.

Further, the polyester resin may be crystalline or noncrystalline.

The glass transition point of the polyester resin is preferably 45° C. or higher and 70° C. or lower, more preferably 50° C. or higher and 65° C. or lower. If the glass transition point is lower than 45° C., the heat-resistant storage stability of the toner is deteriorated, and also a gloss after decolorization is noticeable, and therefore, it is not preferred. Meanwhile, if the glass transition point is higher than 70° C., the low-temperature fixability is deteriorated, and also the decolorizing property when heating is poor, and therefore, it is not preferred.

The weight average molecular weight Mw of the binder resin is preferably 6000 or more and 25000 or less. If the weight average molecular weight Mw is less than 6000, a gloss derived from the resin in a decolorized region is noticeable, and therefore, it is not preferred. Meanwhile, if the weight average molecular weight Mw exceeds 25000, the fixing temperature of the toner is generally higher than the decolorization temperature of an image, and the toner cannot be used as a decolorizable toner, and therefore, it is not preferred.

Incidentally, the weight average molecular weight Mw can be measured by GPC as described above.

In addition, it is preferred that the electron donating color developable agent and the electron accepting color developing agent of the toner are microencapsulated as a color material. By the microencapsulation of these components, the components are rarely affected by the external environment, and the color development and decolorization can be freely controlled.

It is preferred that the resulting microcapsules serving as the color material further contain a temperature control agent. The temperature control agent controls the decolorization temperature. The temperature control agent is a substance having a large temperature difference between the melting point and the solidification point. When the temperature control agent is heated to a temperature not lower than the melting point of the temperature control agent, the color material can be decolorized. Further, when the solidification point of the temperature control agent is normal temperature or lower, the color material maintained in a decolorized state even at normal temperature can be formed.

Examples of the temperature control agent include an alcohol, an ester, a ketone, an ether, and an acid amide.

As the temperature control agent, an ester is particularly preferred. Specific examples thereof include an ester of a carboxylic acid containing a substituted aromatic ring, an ester of a carboxylic acid containing an unsubstituted aromatic ring with an aliphatic alcohol, an ester of a carboxylic acid containing a cyclohexyl group in the molecule, an ester of a fatty acid with an unsubstituted aromatic alcohol or a phenol, an ester of a fatty acid with a branched aliphatic alcohol, an ester of a dicarboxylic acid with an aromatic alcohol or a branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used by mixing two or more of them.

Subsequently, the physical properties of the toner will be described.

The glass transition point (Tg) of the toner is preferably 35° C. or higher and 65° C. or lower. If the glass transition point (Tg) of the toner is lower than 35° C., the heat-resistant storage stability of the toner is deteriorated, and also a gloss derived from the toner when the toner is decolorized by heating is noticeable, and therefore, it is not preferred. Meanwhile, if the glass transition point (Tg) of the toner is higher than 65° C., the low-temperature fixability is deteriorated, and also the property of decolorization by heating is deteriorated.

The softening point (Tm) of the toner is preferably 80° C. or higher and 120° C. or lower. If the softening point (Tm) of the toner is lower than 80° C., the storage stability of the toner is deteriorated. Meanwhile, if the softening point (Tm) of the toner is higher than 120° C., the fixing temperature is increased, and therefore, it is not preferred from the viewpoint of energy saving.

The toluene insoluble content in the toner is preferably 15% by mass or more and 40% by mass or less. The toluene insoluble content is a numerical value indicating the degree of crosslinking of a resin contained in the toner. If the toluene insoluble content is more than 40% by mass, the fixing temperature of the toner is generally higher than the decolorization temperature at which the decolorizable toner is decolorized. Meanwhile, if the toluene insoluble content is less than 15% by mass, even when the decolorizable toner is heated to decolorize the toner, a gloss derived from the resin in the decolorized region is noticeable, and therefore, it is not preferred.

Incidentally, the toner may further contain a release agent, a charge control agent, or the like.

The release agent improves the releasing property from a fixing member when the toner is fixed on a sheet by heating or applying pressure. Examples of the release agent include aliphatic hydrocarbon waxes such as low molecular weight polyethylenes having a molecular weight of about 1000, low molecular weight polypropylenes having a molecular weight of about 1000, polyolefin copolymers, polyolefin wax, paraffin wax, and Fischer-Tropsch wax, and modified products thereof; vegetable waxes such as candelilla wax, carnauba wax, Japan wax, jojoba wax, and rice wax; animal waxes such as bees wax, lanolin, and whale wax; mineral waxes such as montan wax, ozokerite, and ceresin; fatty acid amides such as linoleic acid amide, oleic acid amide, and lauric acid amide; functional synthetic waxes; and silicone waxes.

In this embodiment, it is particularly preferred that the release agent has an ester bond composed of an alcohol component and a carboxylic acid component. Examples of the alcohol component include higher alcohols, and examples of the carboxylic acid component include saturated fatty acids having a linear alkyl group; unsaturated fatty acids such as monoenoic acid and polyenoic acid; and hydroxyl fatty acids. Further, as the carboxylic acid component, an unsaturated polyvalent carboxylic acid such as maleic acid, fumaric acid, citraconic acid, or itaconic acid may be used. Further, an anhydride thereof may also be used.

The softening point of the release agent is from 50° C. to 120° C., more preferably from 60° C. to 110° C. for enabling the fixing at a low temperature from the viewpoint of low energy or prevention of curling of a sheet.

The charge control agent controls a frictional charge quantity.

As the charge control agent, a metal-containing azo compound is used, and the metal element is preferably a complex or a complex salt of iron, cobalt, or chromium, or a mixture thereof. Further, as the charge control agent, a metal-containing salicylic acid derivative compound may also be used, and the metal element is preferably a complex or a complex salt of zirconium, zinc, chromium, or boron, or a mixture thereof.

Incidentally, in the toner, an external additive in addition to toner particles may be further mixed.

The external additive adjusts the fluidity or chargeability of the toner. The external additive can be mixed in an amount of from 0.01 to 20% by mass of the total amount of the toner particles. The external additive comprises inorganic fine particles, and silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a size of 1 μm or less may be added as the external additive for improving the cleaning property.

Subsequently, the process for producing the toner according to this embodiment will be described with reference to FIG. 1. FIG. 1 is a flow chart showing a flow of a process for producing a toner. First, a color material composed of a color developable agent, a color developing agent, and a temperature control agent is heated and melted (Act 101). Then, the color material is microencapsulated with use of polyurethane by a coacervation method (Act 102). The microencapsulated color material, a binder resin dispersion liquid in which a binder resin is dispersed, and a release agent dispersion liquid in which a release agent is dispersed are aggregated using aluminum sulfate ($Al_2(SO_4)_3$), followed by fusing (Act 103). Then, the fused material is washed (Act 104) and dried (Act 105), whereby a toner is obtained.

Incidentally, the method for the microencapsulation of the color material is not limited to the coacervation method, and a method by polymer deposition, a method using an isocyanate polyol wall material, a method using a urea-formaldehyde or urea-formaldehyde-resorcinol wall forming material, a method using a wall forming material such as a melamine-formaldehyde resin or hydroxypropyl cellulose, an in-situ method by monomer polymerization, an electrolytic dispersion cooling method, a spray-drying method, or the like may be used.

Further, the binder resin can also be prepared by polycondensation of a dicarboxylic acid component, a diol component, and in this embodiment, further a crosslinking component including at least either one of a polyvalent carboxylic acid and a polyhydric alcohol.

The toner according to this embodiment as described above develops a color by binding a leuco dye-based color developable agent typified by crystal violet lactone (CVL) to the color developing agent. Further, the toner according to this embodiment has a characteristic that when the color developable agent and the color developing agent are dissociated from each other, the color is erased. The toner according to this embodiment decolorizes at a temperature higher than the fixing temperature of the toner at which the color developable compound and the color developing agent are dissociated with each other. Accordingly, the toner is not decolorized at a fixing temperature, and the fixed toner can be decolorized by heating to a temperature higher than the fixing temperature.

A device for decolorizing the decolorizable toner according to this embodiment is not particularly limited as long as the device is capable of heating to a temperature not lower than the decolorization temperature. However, similar to a fixing device of an image forming apparatus, a decolorizing device which performs decolorization by heating paper when the paper is nipped and conveyed is preferred. As the decolorizing device, an exclusive device which has such a decolorizing mechanism may be used or a fixing device of an image forming apparatus which also has a decolorizing function may be used.

Subsequently, the toner according to this embodiment will be further described with reference to Examples.

First, processes for producing toners of respective Examples and Comparative Examples will be described.

EXAMPLE 1

First, as a binder resin to be contained in a toner, a polyester resin having a weight average molecular weight Mw of 8200 was prepared by polycondensation of 34 parts by weight of terephthalic acid, 54 parts by weight of an ethylene oxide compound of bisphenol A, and 12 parts by weight of trimellitic acid. Then, a finely pulverized binder resin and wax dispersion liquid was prepared by mixing 95 parts by weight of the thus prepared polyester resin, 5 parts by weight of rice wax as a release agent, 1.0 parts by weight of Neogen R (manufactured by Dai-ichi Kogyo Seiyaku Co., Ltd.) as an anionic emulsifying agent, and 2.1 parts by weight of dimethylaminoethanol as a neutralizing agent using a high-pressure homogenizer.

Subsequently, a color material was prepared by mixing 10 parts by weight of crystal violet lactone (CVL) which is a leuco dye as a color developable agent, 10 parts by weight of benzyl 4-hydroxybenzoate as a color developing agent, and 80 parts by weight of 4-benzyloxyphenylethyl laurate as a temperature control agent, and heating and melting the resulting mixture.

Then, the color material was microencapsulated by a coacervation method.

Then, 10 parts by weight of the microencapsulated color material and 90 parts by weight of the finely pulverized binder resin and wax dispersion liquid were aggregated using aluminum sulfate ($Al_2(SO_4)_3$), followed by fusing. Then, the fused material was washed and dried, whereby toner particles were obtained. Subsequently, 3.5 wt % of hydrophobic silica ($SiO_2$) and 0.5 wt % of titanium oxide ($TiO_2$) were externally added and mixed with 100 parts by weight of the toner particles, whereby a toner of Example 1 was obtained.

EXAMPLE 2

A polyester resin having a weight average molecular weight Mw of 7500 was prepared by polycondensation of 32 parts by weight of terephthalic acid, 53 parts by weight of an ethylene oxide compound of bisphenol A, and 15 parts by weight of trimellitic acid in the same manner as in Example 1. Then, by using this polyester resin, a toner of Example 2 was prepared in the same manner as in Example 1.

EXAMPLE 3

A toner of Example 3 was prepared in the same manner as in Example 1 except that a polyester resin having a weight average molecular weight Mw of 8500 was prepared by polycondensation of 36 parts by weight of terephthalic acid, 59 parts by weight of an ethylene oxide compound of bisphenol A, and 5 parts by weight of trimellitic acid in place of the polyester resin in Example 1, and carnauba wax was used as a release agent having different physical properties from those of the release agent in Example 1.

COMPARATIVE EXAMPLE 1

A polyester resin having a weight average molecular weight Mw of 7500 was prepared by polycondensation of 39 parts by weight of terephthalic acid and 61 parts by weight of an ethylene oxide compound of bisphenol A in the same manner as in Example 1. Then, by using this polyester resin, a toner of Comparative Example 1 was prepared in the same manner as in Example 1.

COMPARATIVE EXAMPLE 2

A toner of Comparative Example 2 was prepared in the same manner as in Example 1 except that a polyester resin having a weight average molecular weight Mw of 5800 was prepared by polycondensation of 39 parts by weight of terephthalic acid and 61 parts by weight of an ethylene oxide compound of bisphenol A in the same manner as in Example 1, and carnauba wax was used as a release agent having different physical properties from those of the release agent in Example 1.

Evaluation Tests for Toners

In order to evaluate the toners of Examples 1 to 3 and Comparative Examples 1 and 2 prepared above, the weight average molecular weight Mw of the binder resin, the content of trimellitic acid, the toluene gel content (toluene insoluble content) (% by mass), the fixing temperature of the toner, the decolorization temperature at which the toner is decolorized, and the glossiness in the decolorized region were measured for the respective Examples and Comparative Examples, and the results are shown in the table of FIG. 2.

Incidentally, the fixation was performed using a developer prepared by mixing each of the toners of Examples and Comparative Examples with a carrier in an image forming apparatus (e-STUDIO 3520C, manufactured by Toshiba Tec Corporation). At this time, a temperature at which fixation can be performed was measured and a fixing temperature was determined.

Further, the toner fixed was decolorized using a device obtained by modifying a fixing device (fixing roller: pressing roller type) of an image forming apparatus of the same type as above so that the device also functions as a decolorizing device.

The weight average molecular weight Mw was measured by the GPC method for each of the binder resins used in the respective Examples and Comparative Examples. In the measurement, an instrument manufactured by WATERS, Inc. was used. As the detector, a differential refractive index detector (RI) manufactured by WATERS, Inc. was used. As the eluent (mobile phase), tetrahydrofuran (THF) was used.

The toluene gel content (toluene insoluble content) was determined by measuring the insoluble content after each of the toners of Examples and Comparative Examples was immersed in toluene for 2 hours, and was expressed in % by mass.

The glossiness in a region where the toner was decolorized is a value obtained by forming an image on a sheet using each of the toners of Examples and Comparative Examples, heating the formed image to decolorize the image, and then, measuring the glossiness in the decolorized region. The measurement was performed using a glossmeter (VG-2000) manufactured by Nippon Denshoku Industries Co., Ltd. according to Test Method for Specular Glossiness (JIS Z 8741) at an incident and reflection angle of 60°.

When discussing the evaluation results (FIG. 2) of the toners of Examples and Comparative Examples described above, it was found that, the toners of Examples 1 and 2 showed a glossiness lower than 10 (about 5), and therefore, light in a decolorized region after decolorization was hardly reflected and the decolorized region was not noticeable. Further, the toner of Example 3 could suppress the glossiness relatively low due to the crosslinking component.

Further, a decolorizing time was within 1 second and decolorization could be achieved in a short time in the case of all Examples.

On the other hand, as for Comparative Examples, the toner of Comparative Example 1 having a weight average molecular weight of 7500 showed a glossiness of 12, which was higher than that of Examples, and a gloss in the decolorized region after decolorization was noticeable.

Further, the toner of Comparative Example 2 showed a high glossiness, and a gloss in the decolorized region after decolorization was noticeable.

As described in detail in the above, according to the technique described in this specification, a toner which gives a less gloss after decolorization can be provided.

While certain embodiments have been described, these embodiments have been presented by way of example only, and are not intended to limit the scope of invention. Indeed, the novel compound described herein may be embodied in a variety of other forms; furthermore, various omissions, substitutions and changes in the form of the compound described herein may be made without departing from the spirit of the inventions. The accompanying claims and their equivalents are intended to cover such forms or modifications as would fall within the scope and spirit of the inventions.

What is claimed is:

1. An electrophotographic toner, which is decolorable with heat, comprising an electron donating color developable agent, an electron accepting color developing agent, a temperature control agent, and a binder resin which is a polyester resin obtained by polycondensation of a carboxylic acid component and an alcohol component and has a crosslinked structure formed of trimellitic acid contained in the binder resin in an amount of from 3 to 15 wt % of the total weight of the binder resin, wherein at least the electron donating color developable agent, the electron accepting color developing agent, and the temperature control agent are microencapsulated in a same microcapsule, and wherein the toner has a toluene insoluble content of 15% by mass or more and 40% by mass or less of the total weight of the binder resin.

2. The toner according to claim 1, wherein the toner is decolorized at a temperature higher than the fixing temperature of the toner.

3. The toner according to claim 1, wherein the polyester resin has a glass transition temperature of 45° C. or higher and 70° C. or lower.

* * * * *